US011840918B2

(12) United States Patent
Zhang et al.

(10) Patent No.: US 11,840,918 B2
(45) Date of Patent: Dec. 12, 2023

(54) MANUAL/AUTOMATIC NON-ELECTRIC-CONNECTION BOREHOLE CLINOMETER AND MEASUREMENT METHOD

(71) Applicant: CHINA UNIVERSITY OF GEOSCIENCES (WUHAN), Wuhan (CN)

(72) Inventors: Yongquan Zhang, Wuhan (CN); Huiming Tang, Wuhan (CN); Junrong Zhang, Wuhan (CN); Changdong Li, Wuhan (CN); Ding Xia, Wuhan (CN); Chengyuan Lin, Wuhan (CN); Qianyun Wang, Wuhan (CN)

(73) Assignee: CHINA UNIVERSITY OF GEOSCIENCES (WUHAN), Wuhan (CN)

( * ) Notice: Subject to any disclaimer, the term of this patent is extended or adjusted under 35 U.S.C. 154(b) by 307 days.

(21) Appl. No.: 17/401,339

(22) Filed: Aug. 13, 2021

(65) Prior Publication Data

US 2023/0010013 A1 Jan. 12, 2023

Related U.S. Application Data

(63) Continuation of application No. PCT/CN2021/107495, filed on Jul. 21, 2021.

(30) Foreign Application Priority Data

Jul. 6, 2021 (CN) ..... 202110762412.9

(51) Int. Cl.
*E21B 47/022* (2012.01)
*E21B 23/14* (2006.01)
(Continued)

(52) U.S. Cl.
CPC ..... *E21B 47/022* (2013.01); *B66D 1/04* (2013.01); *B66D 1/12* (2013.01); *B66D 1/14* (2013.01);
(Continued)

(58) Field of Classification Search
CPC ..... E21B 23/14; E21B 47/022; E21B 47/01; E21B 47/024; E21B 47/026; B66D 1/04; B66D 1/12; B66D 1/14; B66D 2700/025
See application file for complete search history.

(56) References Cited

U.S. PATENT DOCUMENTS

| | | | |
|---|---|---|---|
| 7,216,055 | B1 | 5/2007 | Horton et al. |
| 7,418,364 | B1 | 8/2008 | Horton et al. |
| 10,746,756 | B2 | 8/2020 | Zhang et al. |

OTHER PUBLICATIONS

Translation of CN 204613750. (Year: 2015).*
(Continued)

*Primary Examiner* — Zakiya W Bates
(74) *Attorney, Agent, or Firm* — True Shepherd LLC; Andrew C. Cheng

(57) ABSTRACT

In a manual/automatic non-electric-connection borehole clinometer for a landslide, a clinometer probe completes borehole inclination measurement; a hoisting mechanism is connected to the clinometer probe by a pull rope; and a first tooth disc of an automatic clutch and a first tooth disc of a manual clutch are fixed to a left shaft end and a right shaft end of the hoisting mechanism respectively, a second tooth disc of the automatic clutch is fixed to a driving shaft of an electric driving mechanism and selectively meshes with or moves away from the first tooth disc of the automatic clutch, and a second tooth disc of the manual clutch is fixed to a driving shaft of a manual driving mechanism and selectively meshes with or moves away from the first tooth disc of the manual clutch.

10 Claims, 10 Drawing Sheets

(51) Int. Cl.
*B66D 1/12* (2006.01)
*B66D 1/14* (2006.01)
*B66D 1/04* (2006.01)

(52) U.S. Cl.
CPC ..... *E21B 23/14* (2013.01); *B66D 2700/025* (2013.01)

(56) References Cited

OTHER PUBLICATIONS

Translation of CN 111637867. (Year: 2020).*
Translation of CN 109631842. (Year: 2019).*
Translation of JP S6315111. (Year: 1988).*

* cited by examiner

MANUAL/AUTOMATIC NON-ELECTRIC-CONNECTION BOREHOLE CLINOMETER AND MEASUREMENT METHOD

CROSS-REFERENCE TO RELATED APPLICATIONS

This application is a continuation of International Patent Application No. PCT/CN2021/107495 with a filing date of Jul. 21, 2021, designating the United States, now pending, and further claims priority to Chinese Patent Application No. 202110762412.9 with a filing date of Jul. 6, 2021. The content of the aforementioned applications, including any intervening amendments thereto, are incorporated herein by reference.

TECHNICAL FIELD

The present disclosure relates to the technical field of geological disaster monitoring and prevention, and particularly relates to a manual/automatic non-electric-connection borehole clinometer and a measurement method.

BACKGROUND

As an essential part in the field of geological disaster monitoring, landslide monitoring is an effective control means for evaluating, predicting and controlling the landslide disasters on the basis of massive geological information, including landslide deformation features, physical and mechanical property changes of a sliding body, landslide underground environment changes such as seepage flow velocity and flow direction, etc., acquired by a continuous and reliable monitoring means. It is an important method to monitor displacement for determining the stability of the landslide, and deep displacement monitoring is particularly important because it can reveal deformation features of a deep position of sliding mass so as to determine the position and the deformation rate of the sliding surface.

The borehole clinometers with high precision and good reliability have a long history for deep displacement monitoring of sliding mass, and have been widely used as a deep deformation monitoring apparatus in engineering. The existing borehole clinometer technology mainly uses fixed clinometers and sliding clinometers. The former is featured in real-time monitoring, flexible gauge length configuration, durability and reusability on the basis of combining a plurality of clinometers buried in an in-situ borehole and an automatic data acquisition transceiving system. However, due to the arrangement features, the fixed clinometer has high single-time arrangement cost, as well as limited mountable measurement points and limited range in the boreholes at the same deep displacement. The sliding clinometer is cheap in price, simple in operation and capable of truly reflecting the deformation state of the landslide. However, the sliding clinometer is time-consuming and labor-consuming, the measurement results of which may have large random errors due to operation differences of different operators. In addition, the deformation speed of landslide is divided into several stages corresponding to its evolution process, and different stages require different monitoring frequency and monitoring speed requirements.

SUMMARY

In view of this, the embodiments of the present disclosure provide a manual/automatic non-electric-connection borehole clinometer and a measurement method for solving the above problems.

The embodiments of the present disclosure provide a manual/automatic non-electric-connection borehole clinometer, including:

a clinometer probe capable of being lowered into a clinometer pipe by a pull rope, measuring, without limitation of electric connection, a depth of a borehole, and acquiring and storing inclination data of each measurement point in the clinometer pipe;

a probe traction device including a hoisting mechanism, an electric driving mechanism and a manual driving mechanism; where the pull rope of the hoisting mechanism is connected to the clinometer probe to lift the clinometer probe upwards; a first tooth disc of an automatic clutch and a first tooth disc of a manual clutch are fixed to a left shaft end and a right shaft end of the hoisting mechanism respectively, a second tooth disc of the automatic clutch is fixed to a driving shaft of the electric driving mechanism and selectively meshes with or moves away from the first tooth disc of the automatic clutch, and a second tooth disc of the manual clutch is fixed to a driving shaft of the manual driving mechanism and selectively meshes with or moves away from the first tooth disc of the manual clutch; and when the second tooth disc of the automatic clutch meshes with the first tooth disc of the automatic clutch, the driving shaft of the electric driving mechanism drives the hoisting mechanism to regularly and intermittently lift the clinometer probe upwards, and when the second tooth disc of the manual clutch meshes with the first tooth disc of the manual clutch, the driving shaft of the manual driving mechanism drives the hoisting mechanism to regularly and intermittently lift the clinometer probe upwards.

Further, the probe traction device may further include a base, the hoisting mechanism may be fixed to the base, and the electric driving mechanism and the manual driving mechanism may be movably mounted on the base and located on a left side and a right side of the hoisting mechanism respectively.

Further, the probe traction device may further include a gantry, a slide rail extending in a left-right direction may be arranged on the base, a slider in sliding fit with the slide rail may be fixed to a bottom of the gantry, the hoisting mechanism may be located on an inner side of the gantry, the electric driving mechanism and the manual driving mechanism may be fixed to the gantry separately, the electric driving mechanism and the manual driving mechanism may be located on a left side and a right side of the hoisting mechanism respectively and spaced from same, and the hoisting mechanism may be located between the second tooth disc of the automatic clutch and the second tooth disc of the manual clutch and spaced from same.

Further, a gear actuator rod may be fixed to a top of the gantry, the probe traction device may further include a case housing, the base may be covered with an opening in a lower side of the case housing, the hoisting mechanism, the electric driving mechanism and the manual driving mechanism may be located in the case housing, a gear hole may be provided in a position, opposite the gear actuator rod, of the case housing, three gear clamping grooves may be provided in a side wall of the gear hole in the left-right direction, an elastic sheet may be arranged on one side, facing the gear clamping grooves, of the gear actuator rod, the elastic sheet may be located in the gear clamping groove, and an upper end of the gear actuator rod may be located above the case housing;

when the gear actuator rod is located in the rightmost gear clamping groove, the first tooth disc of the manual clutch may mesh with the second tooth disc of the manual clutch;

when the gear actuator rod is located in the middle gear clamping groove, the first tooth disc of the manual clutch may be spaced from the second tooth disc of the manual clutch, and the first tooth disc of the automatic clutch may be spaced from the second tooth disc of the automatic clutch; and when the gear actuator rod is located in the leftmost gear clamping groove, the first tooth disc of the automatic clutch may mesh with the second tooth disc of the automatic clutch.

Further, the automatic driving mechanism may include a stepping driving motor and a motor reducer, the motor reducer and the stepping driving motor being connected together and fixed to the gantry.

Further, the manual driving mechanism may include a manual rocking handle and a manual gear speed regulator, the manual gear speed regulator being fixed to the gantry, and the manual rocking handle being connected to the manual gear speed regulator and driving the manual gear speed regulator to rotate.

Further, the probe traction device may further include a position measurement mechanism, the position measurement mechanism including a rotary encoder and a rotary coupling wheel, where the rotary encoder may be mounted on the base, the rotary coupling wheel may be mounted on an input shaft of the rotary encoder, the pull rope may be wound around the rotary coupling wheel by a circle, and the rotary encoder may be used for acquiring a rotation distance of the rotary coupling wheel so as to acquire a pull distance of the pull rope.

Further, the position measurement mechanism may further include a rope arranging cover, the rope arranging cover being fixed to the base, the rotary coupling wheel being located in the rope arranging cover, a shaft penetrating hole penetrating a position, opposite the input shaft of the rotary encoder, of the rope arranging cover, and threading holes penetrating two ends of the rope arranging cover and two ends of the pull rope.

Further, the clinometer probe may include a probe pipe housing, an upper end and a lower end of the probe pipe housing are separately provided with guide roller devices, the guide roller devices are configured to roll in a guide groove of the clinometer pipe, and a clinometer circuit module, an interface module and a power supply module are fixed in the probe pipe housing, the clinometer circuit module may be used for acquiring and storing clinometer data, the interface module may be configured to be connected to an external apparatus to transmit the clinometer data, and the power supply module may be electrically connected to the clinometer circuit module to supply power.

The embodiments of the present disclosure further provide a measurement method using the above manual/automatic non-electric-connection borehole clinometer for a landslide and including:

S1, starting a measurement mode of a clinometer probe, and placing the clinometer probe into a clinometer pipe;

S2, separating a first tooth disc of an automatic clutch from a second tooth disc of the automatic clutch, separating a first tooth disc of a manual clutch from a second tooth disc of the manual clutch, and making the clinometer probe slide to a bottom of the clinometer pipe under the action of gravity;

S3, making the first tooth disc of the automatic clutch mesh with the second tooth disc of the automatic clutch, separating the first tooth disc of the manual clutch from the second tooth disc of the manual clutch, starting a probe traction device to automatically and intermittently lift the clinometer probe, and stopping lifting until the clinometer probe ascends to a pipe opening of the clinometer pipe, so as to complete the measurement of the clinometer pipe; or separating, when power supplied to the clinometer probe is insufficient, the first tooth disc of the automatic clutch from the second tooth disc of the automatic clutch, making the first tooth disc of the manual clutch mesh with the second tooth disc of the manual clutch, and manually and continuously rotating a manual rocking handle to transmit intermittent motion by a manual gear speed regulator, so as to intermittently lift the clinometer probe until the clinometer probe reaches the orifice to complete measurement;

S4, taking out the clinometer probe from the clinometer pipe, closing the measurement mode of the clinometer probe, and acquiring clinometer data measured by the clinometer probe; and S5, extracting an effective measurement point data segment from the clinometer data, and capturing a stable data segment to calculate a mean value, so as to calculate inclination angle information of a corresponding measurement point position.

The technical solution provided in the present disclosure has the beneficial effects:

A probe traction device is connected to a clinometer probe by a pull rope instead of a traditional cable. The non-electric-connection mode, that is the pull rope, removes limitation on a depth of a monitoring hole due to the problems of a limited signal transmission distance, a large far-end power supply voltage drop, a large cable weight, etc., manual measurement and automatic measurement are integrated, a measurement mode is flexible and convenient to switch, and the comprehensive measurement cost is low.

A monitoring speed and frequency of an automatic gear in the probe traction device are adjustable, which may meet low-frequency monitoring in a landslide creep stage and may also meet high-frequency and quick-response monitoring requirements in a landslide severe sliding or accelerated deformation stage, thereby having important significance in deep deformation monitoring of landslide disasters. The traditional cable connection method is not used between the probe traction device and the clinometer probe, and a non-electric connection mode, that is the steel wire rope, removes the limitation on the depth of the monitoring hole due to the problems of the limited signal transmission distance, the large far-end power supply voltage drop, the large cable weight, etc. With wide application scenes, the present disclosure can work in all weather, all over the world and in all time. With mature technologies, the present disclosure has reasonable design and good economical efficiency, and is convenient to popularize and suitable for deep deformation monitoring of landslide disasters.

Figure 1:
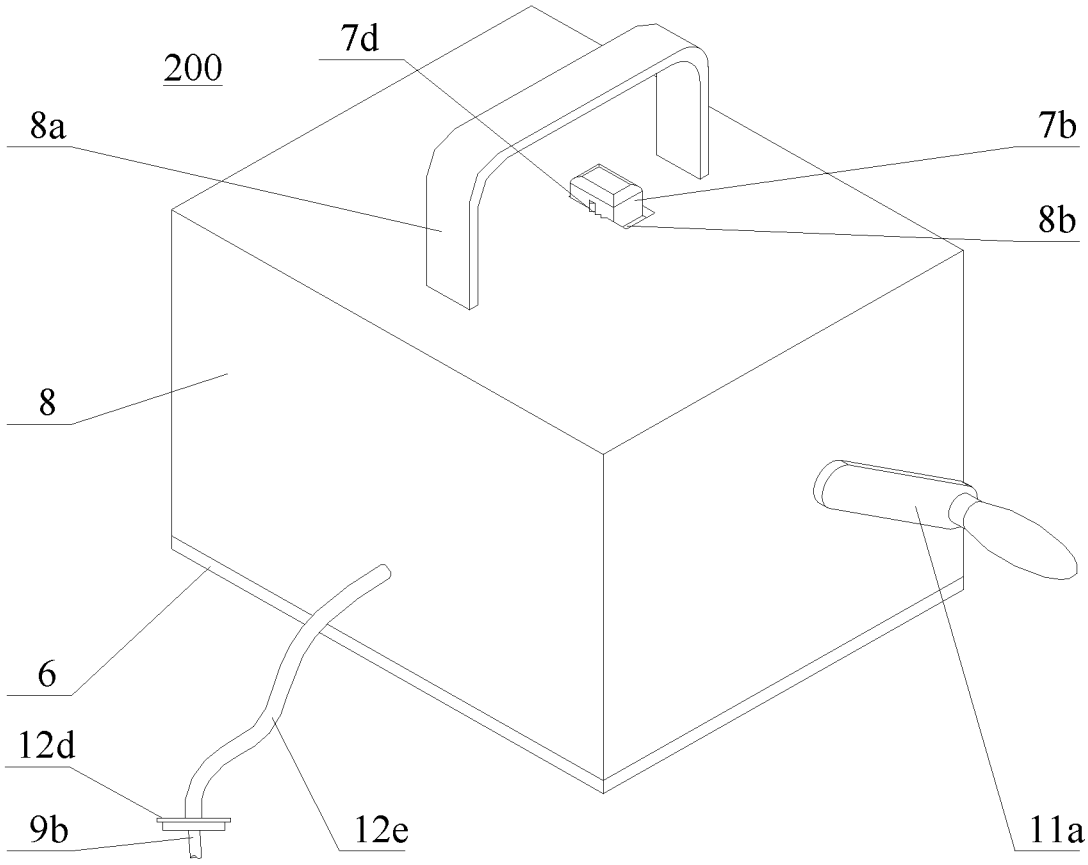
FIG. 1 is a schematic structural diagram of an embodiment of a probe traction device of a manual/automatic non-electric-connection borehole clinometer for a landslide provided in the present disclosure.
Figure 2:
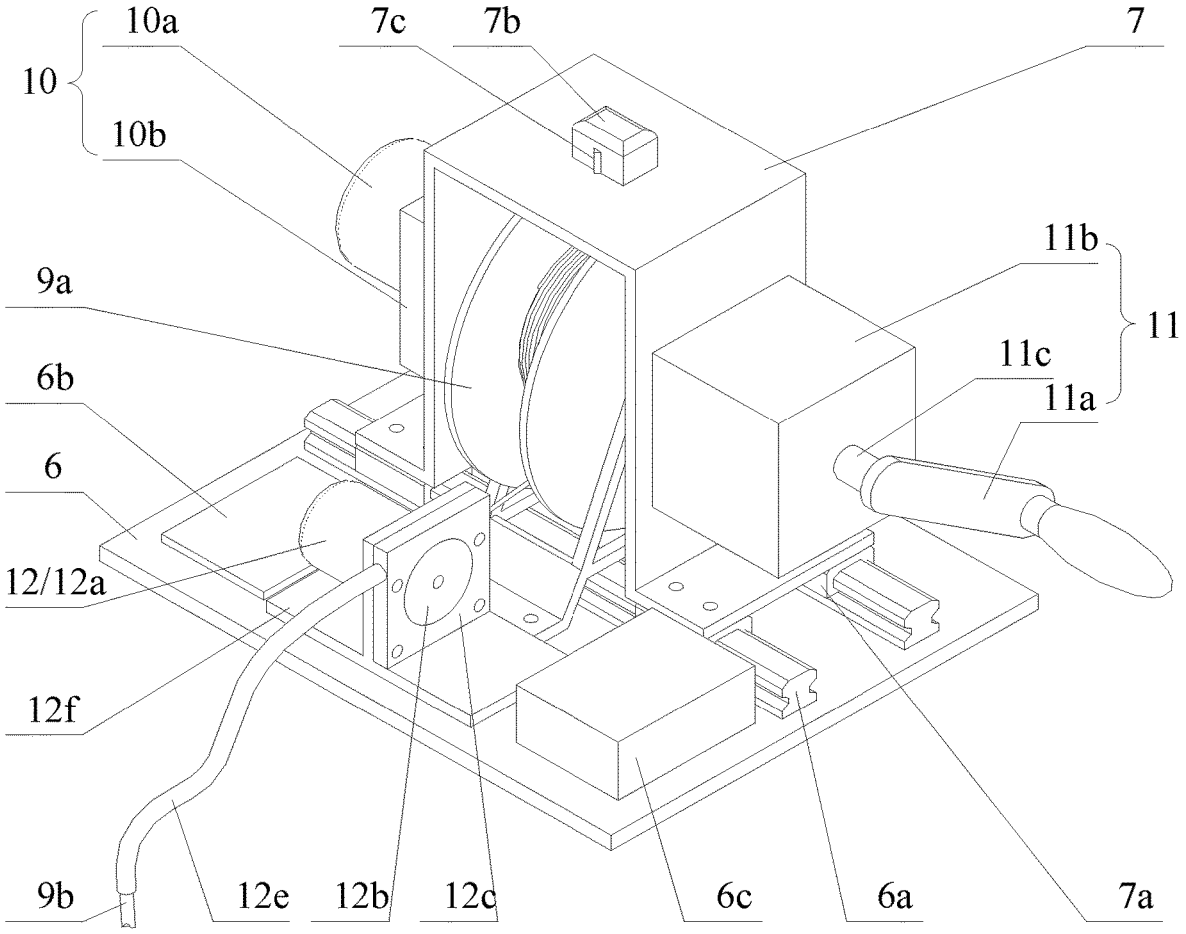
FIG. 2 is a schematic diagram of an internal structure of a probe traction device in FIG. 1.
Figure 3:
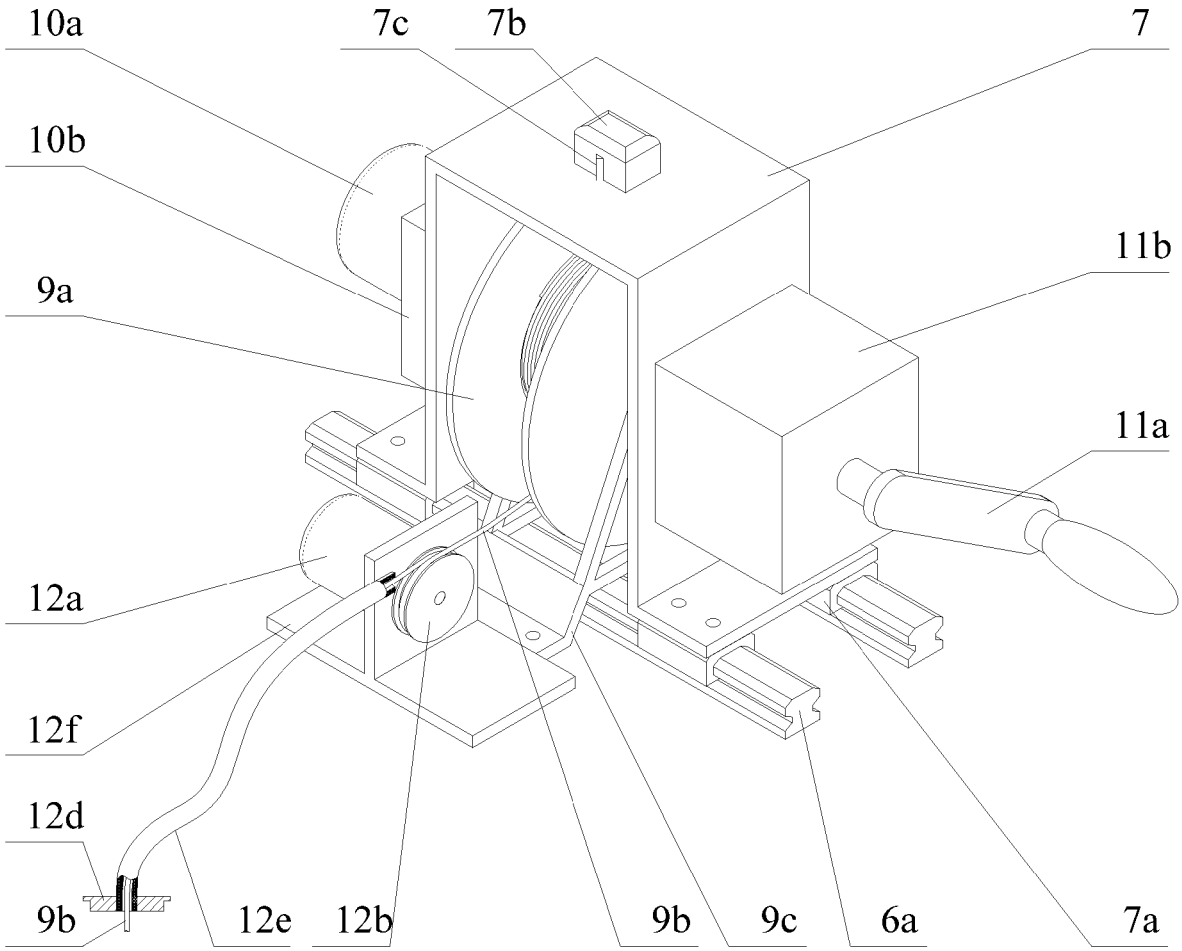
FIG. 3 is a schematic diagram of a partial structure of the probe traction device in FIG. 2.
Figure 4:
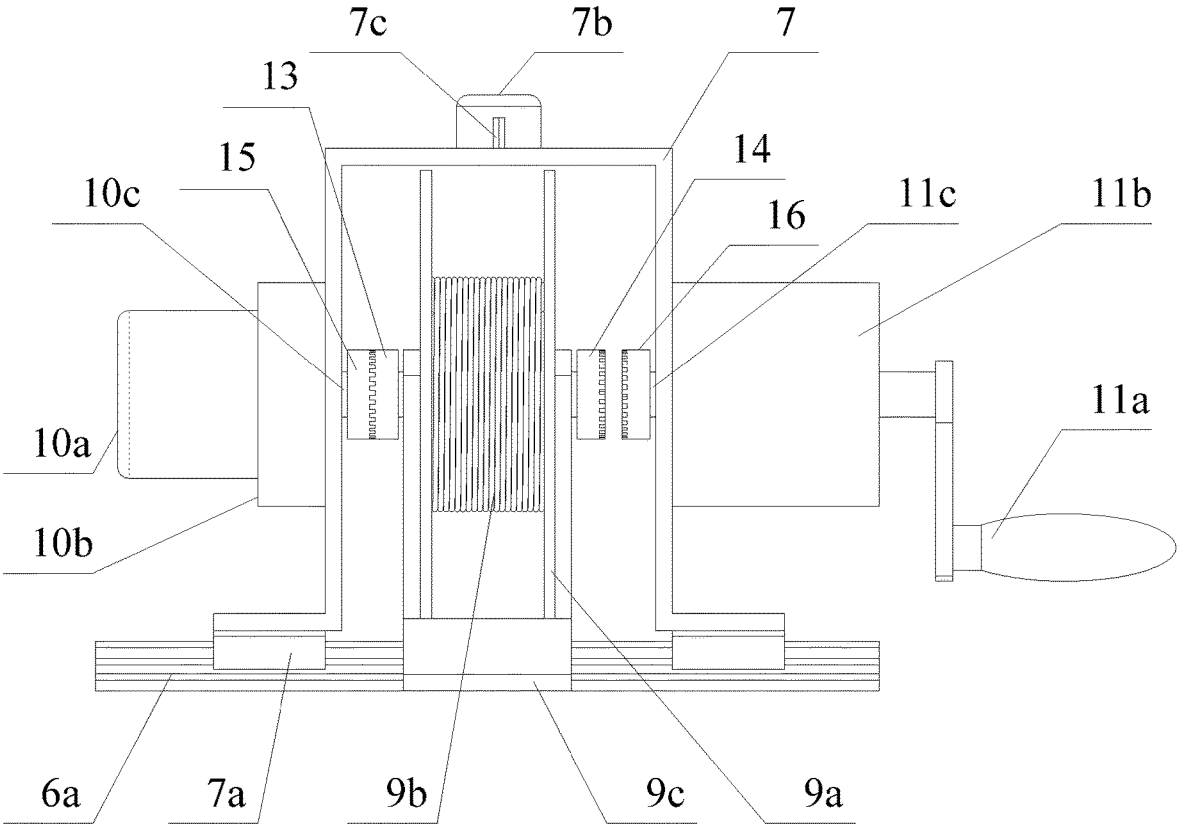
FIG. 4 is a cutaway view of the probe traction device (with a gear actuator rod in an automatic gear) of FIG. 3.
Figure 5:
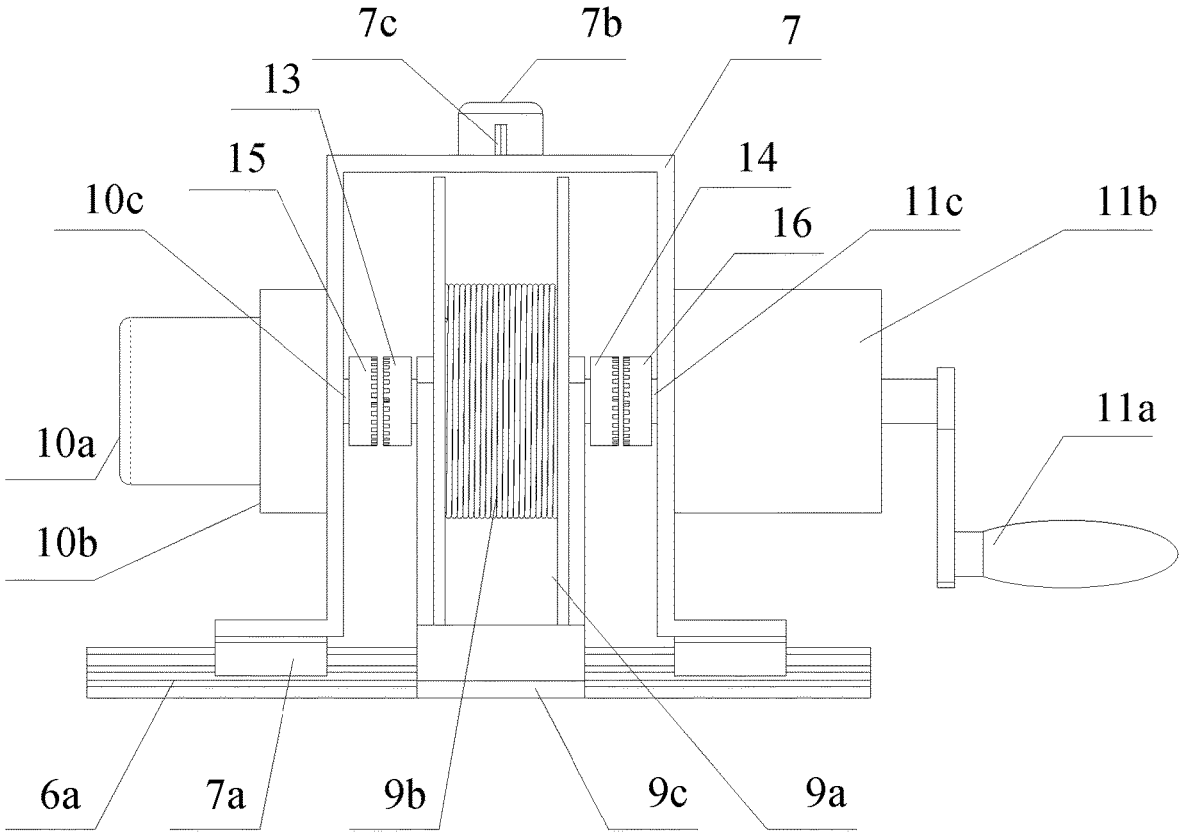
FIG. 5 is a cutaway view of the probe traction device (with the gear actuator rod in a neutral gear) of FIG. 3.
Figure 6:
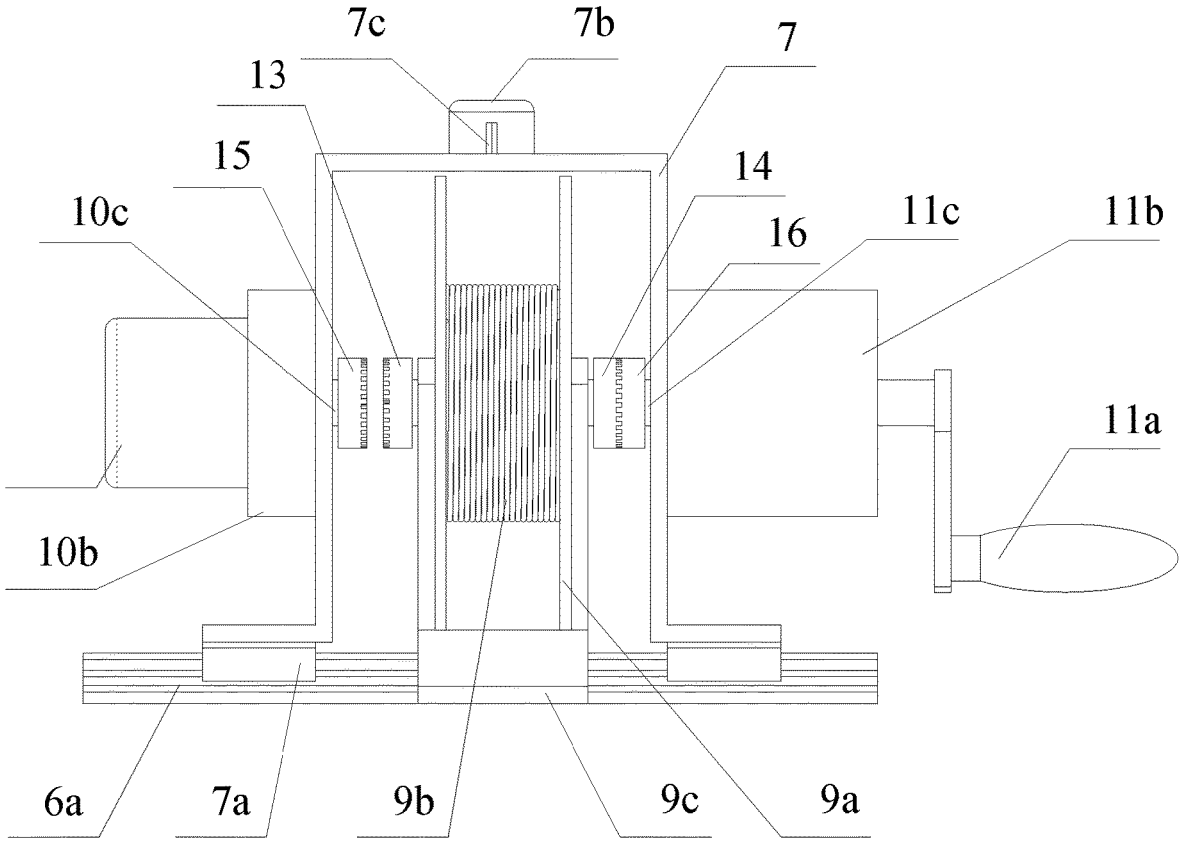
FIG. 6 is a cutaway view of the probe traction device (with the gear actuator rod in a manual gear) of FIG. 3.
Figure 7:
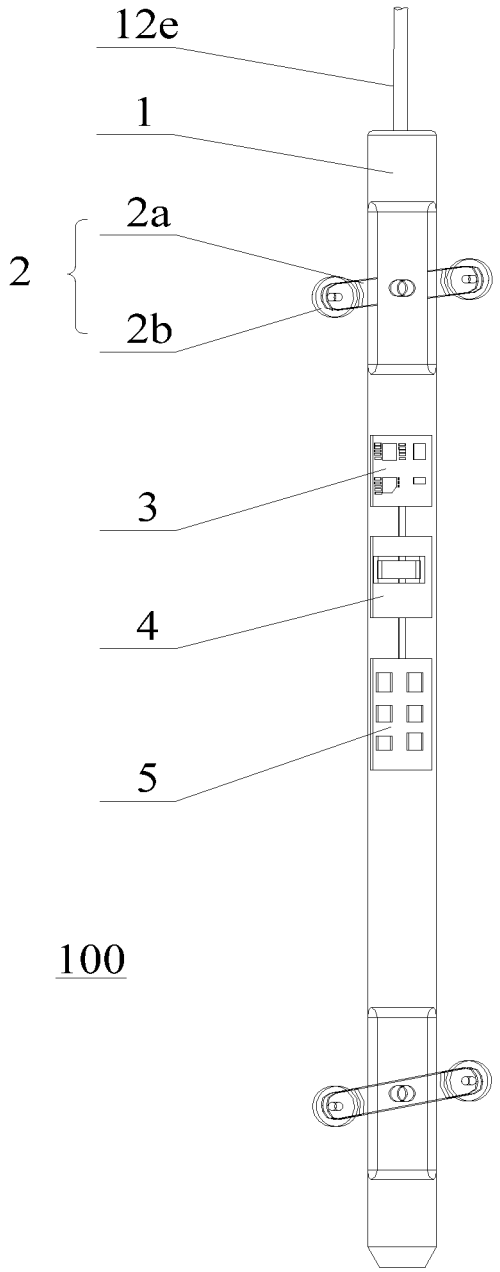
FIG. 7 is a schematic structural diagram of an embodiment of clinometer probe of the manual/automatic non-electric-connection borehole clinometer for a landslide provided in the present disclosure.
Figure 8:
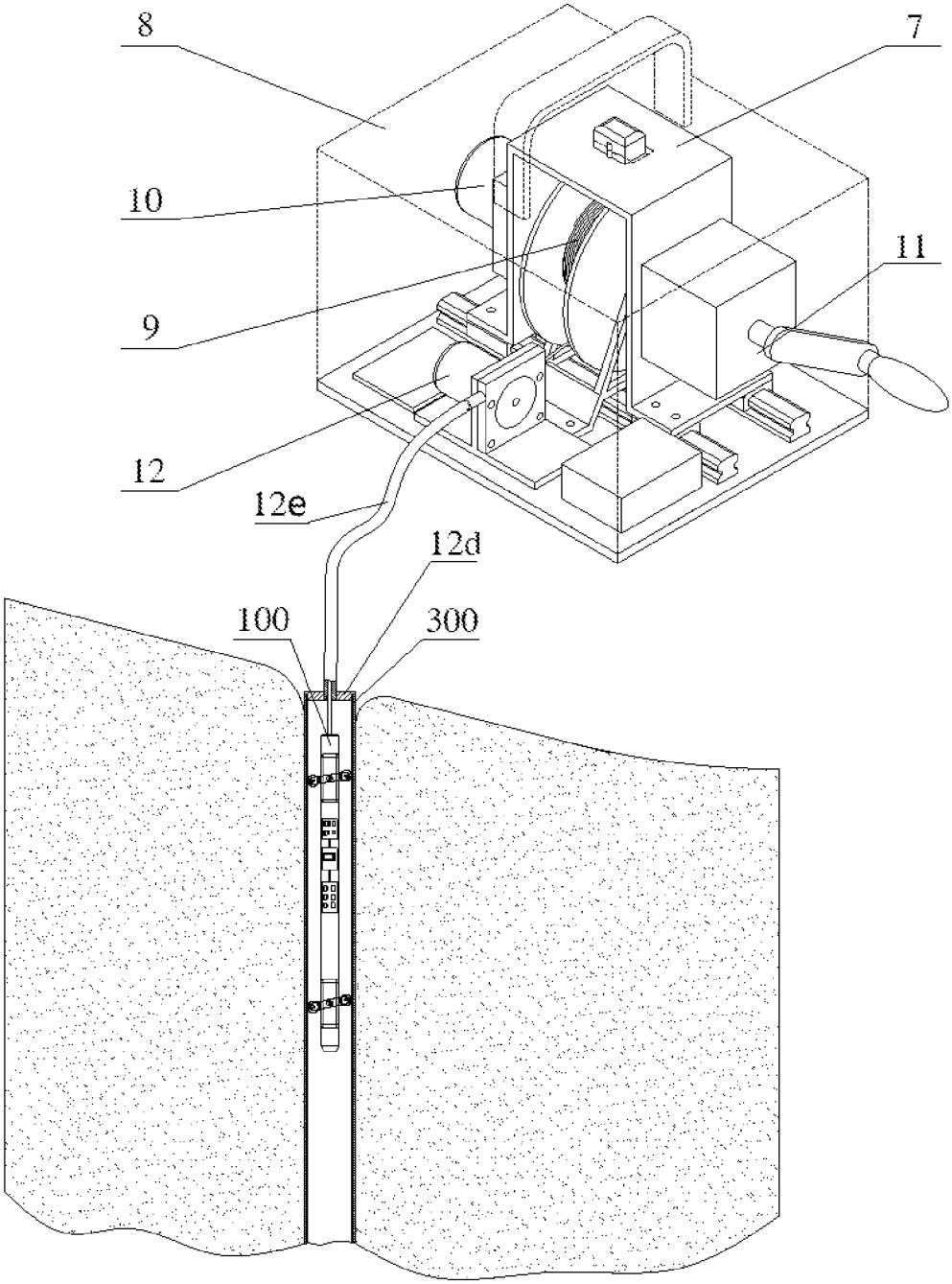
FIG. 8 is a schematic diagram of a manual/automatic cableless borehole clinometer for a landslide provided in the present disclosure and field application.

In the figures: clinometer probe 100, probe traction device 200, clinometer pipe 300, probe pipe housing 1, guide roller device 2, guide support 2*a*, guide roller 2*b*, clinometer circuit module 3, interface module 4, power supply module 5, base 6, slide rail 6*a*, control circuit board 6*b*, power battery 6*c*, gantry 7, slider 7*a*, gear actuator rod 7*b*, elastic sheet 7*c*, gear clamping groove 7*d*, case housing 8, lifting handle 8*a*, gear hole 8*b*, hoisting mechanism 9, reel 9*a*, pull rope 9*b*, hoisting support 9*c*, electric driving mechanism 10, stepping driving motor 10*a*, motor reducer 10*b*, driving shaft 10*c* of electric driving mechanism, manual driving mechanism 11, manual rocking handle 11*a*, manual gear speed regulator 11*b*, driving shaft 11*c* of manual driving mechanism, position measurement mechanism 12, rotary encoder 12*a*, rotary coupling wheel 12*b*, rope arranging cover 12*c*, pipe orifice support cover 12*d*, flexible casing pipe 12*e*, measurement support 12*f*, first tooth disc 13 of automatic clutch, first tooth disc 14 of manual clutch, second tooth disc 15 of automatic clutch, second tooth disc 16 of manual clutch, effective measurement point data segment 17, and lifting process data segment 18.

DETAILED DESCRIPTION OF THE EMBODIMENTS

In order to make the objectives, technical solutions and advantages of the present disclosure clearer, the implementations of the present disclosure are described in more detail below with reference to the accompanying drawings.

With reference to FIGS. 1-8, the embodiments of the present disclosure provide a manual/automatic non-electric-connection borehole clinometer for a landslide, including a clinometer probe 100 and a probe traction device 200.

The clinometer probe 100 is configured to be lowered into a clinometer pipe 300 by a pull rope 9*b*, an independent closed system thereof acquires and stores inclination data of each measurement point in the clinometer pipe 300 and may measure, without limitation of electric connection, a depth of a borehole, and intermittent data features mark a position of each measuring point in a hole in an attached manner. Specifically, with reference to FIG. 7, the clinometer probe 100 includes a probe pipe housing 1, an upper end and a lower end of the probe pipe housing 1 being separately provided with guide roller devices 2, and the guide roller device 2 including a guide support 2*a* and a guide roller 2*b*, where the guide support 2*a* is mounted on the probe pipe housing 1, and the guide roller 2*b* is rotatably mounted on the guide support 2*a*. A guide groove extending in a vertical direction is provided in the clinometer pipe 300, and the guide roller device 2 rolls in the guide groove to clamp the clinometer probe 100 in a direction of the guide groove of the clinometer pipe 300 to be prevented from rotating. A clinometer circuit module 3, an interface module 4 and a power supply module 5 are fixed in the probe pipe housing 1, where the clinometer circuit module 3 is used for acquiring and storing clinometer data, the interface module 4 is used for being connected to an external apparatus to transmit the clinometer data, and the power supply module 5 is electrically connected to the clinometer circuit module 3 to supply power.

With reference to FIGS. 1-6, the probe traction device 200 includes a base 6, a gantry 7, a case housing 8, a hoisting mechanism 9, an electric drive mechanism 10, a manual drive mechanism 11, and a position measurement mechanism 12.

The hoisting mechanism 9 is fixed to the base 6, the hoisting mechanism 9 has an existing structure and includes a reel 9*a* and the pull rope 9*b*, the reel 9*a* is fixed to the base 6 by a hoisting support 9*c*, one end of the pull rope 9*b* is wound around the reel 9*a*, the other end thereof is connected to the clinometer probe 100 and configured to lift the clinometer probe 100 upwards, the pull rope 9*b* is specifically a steel wire rope, the clinometer probe 100 is pulled and lowered into the clinometer pipe 300 by the steel wire rope, and the steel wire rope intermittently lifts the clinometer probe 100 during measurement. In this embodiment, the probe traction device 200 intermittently lifts the clinometer probe 100 upwards at equal intervals to provide an agreed movement feature for the clinometer probe 100 to identify a position of a measurement point data segment in an off-line manner. A first tooth disc 13 of an automatic clutch and a first tooth disc 14 of a manual clutch are fixed to a left shaft end and a right shaft end of the hoisting mechanism 9 respectively, and the automatic clutch and the manual clutch are jaw clutches.

The electric driving mechanism 10 is movably mounted on the base 6 and located on a left side of the hoisting mechanism 9. A second tooth disc 15 of the automatic clutch is fixed to a driving shaft 10*c* of the electric driving mechanism, and the second tooth disc 15 of the automatic clutch selectively meshes with or moves away from the first tooth disc 13 of the automatic clutch. The manual driving mechanism 11 is movably mounted on the base 6 and located on a right side of the hoisting mechanism 9. A second tooth disc 16 of the manual clutch is fixed to a driving shaft 11*c* of the manual driving mechanism, and the second tooth disc 16 of the manual clutch selectively meshes with or moves away from the first tooth disc 14 of the manual clutch.

When the second tooth disc 15 of the automatic clutch meshes with the first tooth disc 13 of the automatic clutch, the driving shaft 10*c* of the electric driving mechanism drives the hoisting mechanism 9 to regularly and intermittently lift the clinometer probe 100 upwards, and when the second tooth disc 16 of the manual clutch meshes with the first tooth disc 14 of the manual clutch, the driving shaft 11*c* of the manual driving mechanism drives the hoisting mechanism 9 to regularly and intermittently lift the clinometer probe 100 upwards.

Specifically, a slide rail 6*a* extending in a left-right direction is arranged on the base 6, a slider 7*a* matching the slide rail 6*a* in a sliding mode is fixed to a bottom of the gantry 7. In this embodiment, the two slide rails 6*a* are arranged one behind the other at intervals, and the two sliders 7*a* are correspondingly arranged at the bottom of the gantry 7, so as to enhance moving stability of the gantry 7. A middle of the hoisting support 9*c* is arched for the slide rail 6*a* to penetrate.

The electric driving mechanism 10 and the manual driving mechanism 11 are fixed to the gantry 7 separately, the hoisting mechanism 9 is located on an inner side of the gantry 7, the electric driving mechanism 10 and the manual driving mechanism 11 are located on a left side and a right side of the hoisting mechanism 9 respectively and spaced from same. The electric driving mechanism 10 and the manual driving mechanism 11 may be mounted on the inner side of the gantry 7. In this embodiment, the electric driving mechanism 10 and the manual driving mechanism 11 are fixed to the left side and the right side of the gantry 7 respectively, receding holes penetrate positions, opposite the driving shaft 10*c* of the electric driving mechanism and the driving shaft 11*c* of the manual driving mechanism, of the gantry 7, the second tooth disc 15 of the automatic clutch and the second tooth disc 16 of the manual clutch are fixed to one ends, penetrating the receding holes and located in the gantry 7, of the two driving shafts correspondingly, and the hoisting mechanism 9 is located between the second tooth disc 15 of the automatic clutch and the second tooth disc 16 of the manual clutch and spaced from same.

In this way, the gantry 7 may be moved leftwards and rightwards. When the gantry 7 is moved leftwards, the first tooth disc 13 of the automatic clutch on a left side of the reel 9*a* meshes with the second tooth disc 15 of the automatic clutch on the electric driving mechanism 10, and the driving shaft 10*c* of the electric driving mechanism may drive the reel 9*a* to rotate, so as to pull the clinometer probe 100 electrically. When the gantry 7 is moved rightwards, the first tooth disc 14 of the manual clutch on a right side of the reel 9*a* meshes with the second tooth disc 16 of the manual clutch on the manual driving mechanism 11, the driving shaft 11*c* of the manual driving mechanism may drive the reel 9*a* to rotate, so as to pull the clinometer probe 100 manually. The reel 9*a* is moved between the second tooth disc 15 of the automatic clutch and the second tooth disc 16 of the manual clutch to separate the first tooth disc 13 of the automatic clutch from the second tooth disc 15 of the automatic clutch and separate the first tooth disc 14 of the manual clutch from the second tooth disc 16 of the manual clutch so as to be in a neutral gear, the steel wire rope is loose, and the clinometer probe 100 may move downwards to the bottom of the clinometer pipe 300 under the action of gravity.

Specifically, the automatic driving mechanism includes a stepping driving motor 10*a* and a motor reducer 10*b*, the motor reducer 10*b* and the stepping driving motor 10*a* being connected together and fixed to the gantry 7, and the driving shaft 10*c* of the electric driving mechanism is mounted on the motor reducer 10*b*.

The manual driving mechanism 11 includes a manual rocking handle 11*a* and a manual gear speed regulator 11*b*, the manual gear speed regulator 11*b* being fixed to the gantry 7, and the manual rocking handle 11*a* being connected to the manual gear speed regulator 11*b* and driving the manual gear speed regulator 11*b* to rotate, and the driving shaft 11*c* of the manual driving mechanism is mounted on the manual gear speed regulator 11*b*. The manual gear speed regulator 11*b* internally has an intermittent transmission mechanism, and an output shaft of the manual gear speed regulator 11*b* outputs intermittent rotation when the manual rocking handle 11*a* is continuously rotated.

A control circuit board 6*b* and a power battery 6*c* are fixed to the base 6 and are used for working flow control, measurement point position positioning and power supply of the probe traction device 200.

The base 6 is covered with an opening in a lower side of a case housing 8 to shield and protect internal components. A lifting handle 8*a* is mounted at a top of the case housing 8, such that the whole device is convenient to move. The hoisting mechanism 9, the electric driving mechanism 10 and the manual driving mechanism 11 are located in the case housing 8, a through hole penetrates a position, opposite the manual rocking handle 11*a*, of the case housing 8, and the manual rocking handle 11*a* penetrates out of the through hole.

For conveniently adjusting a gear, a gear actuator rod 7*b* is fixed to a top of the gantry 7, a gear hole 8*b* is provided in a position, opposite the gear actuator rod 7*b*, of the case housing 8, three gear clamping grooves 7*d* are provided in a side wall of the gear hole 8*b* in the left-right direction, an elastic sheet 7*c* is arranged on one side, facing the gear clamping grooves 7*c*, of the gear actuator rod 7*b*, the elastic sheet 7*c* is located in the gear clamping groove 7*b*, and an upper end of the gear actuator rod 7*b* is located above the case housing 8, such that an operator may actuate the gear actuator rod 7*b* conveniently. When the gear actuator rod 7*b* is located in the rightmost gear clamping groove 7*d*, the first tooth disc 14 of the manual clutch meshes with the second tooth disc 16 of the manual clutch (with reference to FIG. 6, the gear actuator rod 7*b* is in a manual gear); when the gear actuator rod 7*b* is located in the middle gear clamping groove 7*d*, the first tooth disc 14 of the manual clutch is spaced from the second tooth disc 16 of the manual clutch, and the first tooth disc 13 of the automatic clutch is spaced from the second tooth disc 15 of the automatic clutch (with reference to FIG. 5, the gear actuator rod 7*b* is in a neutral gear); and when the gear actuator rod 7*b* is located in the leftmost gear clamping groove 7*d*, the first tooth disc 13 of the automatic clutch meshes with the second tooth disc 15 of the automatic clutch (with reference to FIG. 4, the gear actuator rod 7*b* is in an automatic gear), such that the operator may judge the gear conveniently.

Specifically, the gear actuator rod 7*b* is provided with a notch facing the gear clamping groove 7*d*, the elastic sheet 7*c* is connected into the notch by a spring, one end of the elastic sheet 7*c* is located in the notch, the other end thereof is located outside the notch, the notch and the elastic sheet 7*c* are arranged in a triangular shape on the cross section, in a left-right moving process of the gear actuator rod 7*b*, the spring is compressed, the elastic sheet 7*c* is pushed into the notch under the thrust action of the spring to clamp a left-right sliding position of the gantry 7, and three gears of the automatic gear (FIG. 4), the neutral gear (FIG. 5) and the manual gear (FIG. 6) are formed.

The position measurement mechanism 12 includes a rotary encoder 12*a*, a rotary coupling wheel 12*b*, a rope arranging cover 12*c*, a pipe orifice support cover 12*d* and a flexible casing pipe 12*e*, where the rotary encoder 12*a* is mounted on the base 6 by a measurement support 12*f*, the rotary coupling wheel 12*b* is mounted on an input shaft of the rotary encoder 12*a*, the pull rope 9*b* is wound around the rotary coupling wheel 12*b* by a circle, and the rotary encoder 12*a* is used for acquiring a rotation distance of the rotary coupling wheel 12*b* so as to acquire a pull distance of the pull rope 9*b*. The rope arranging cover 12*c* is fixed to the base 6, the rotary coupling wheel 12*b* is located in the rope arranging cover 12*c*, a shaft penetrating hole penetrates a position, opposite the input shaft of the rotary encoder 12*a*, of the rope arranging cover 12*c*, and threading holes penetrate two ends of the rope arranging cover 12*c* and two ends of the pull rope 9*b*, so as to guarantee a pulling distance of the pull rope 9*b* to be accurately transmitted to the rotary encoder 12*a* and the accuracy of control over a measurement point position. A pipe orifice support cover 12*d* covers a top of the clinometer pipe 300, and a via hole for the pull rope

9*b* to penetrate penetrates the pipe orifice support cover 12*d*. The pull rope 9*b* is sleeved with a flexible casing pipe 12*e*, the flexible casing pipe 12*e* is located between the pipe orifice support cover 12*d* and the rope arranging cover 12*c*, and the two ends of the flexible casing pipe 12*e* are connected with the pipe orifice support cover 12*d* and the rope arranging cover 12*c* separately. The flexible casing pipe 12*e* is not flexible in an axial direction, but may generate flexural deformation to guarantee that the probe traction device 200 is not limited by a spatial position in the field.

Figure 10:
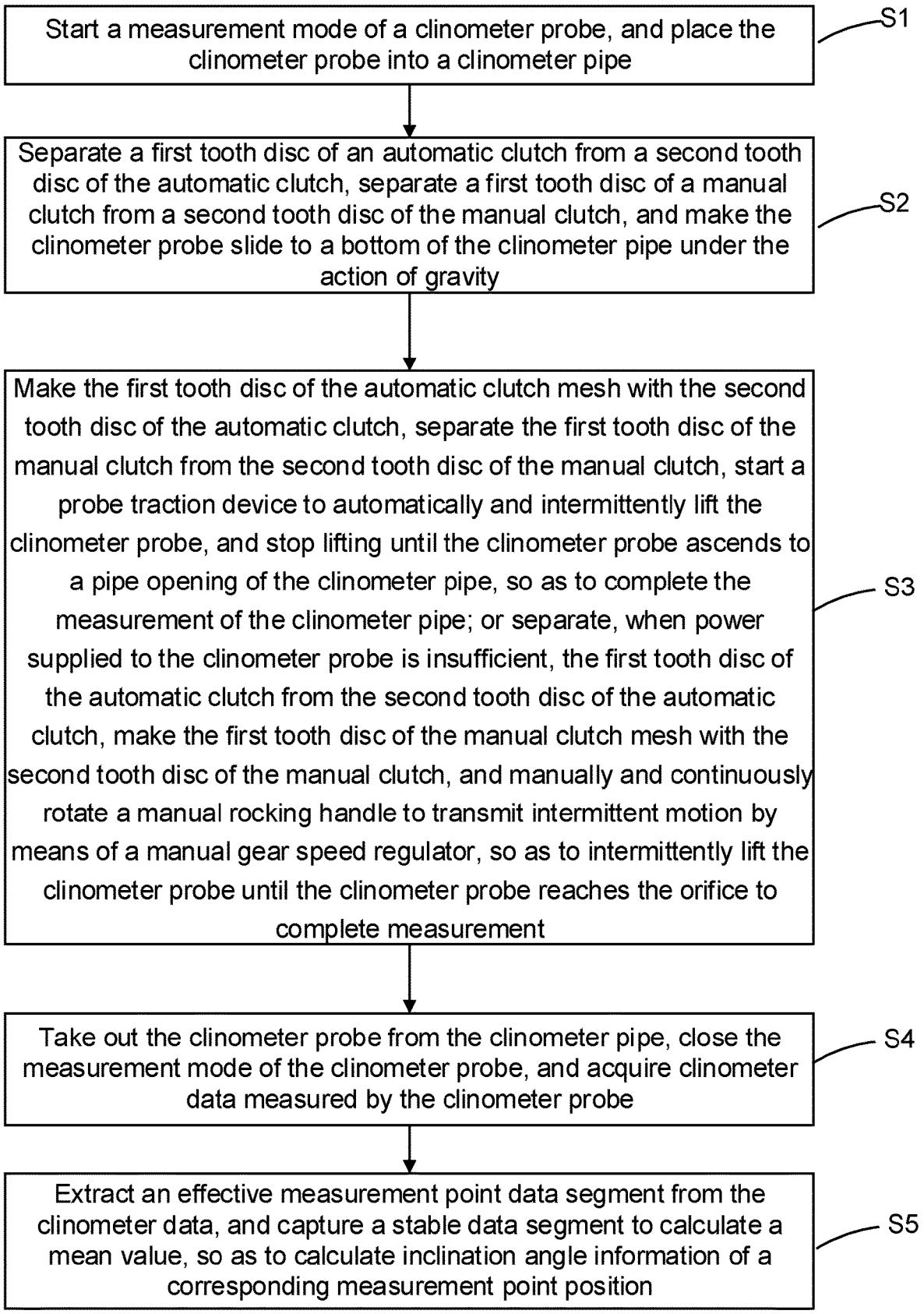
FIG. 10 is a schematic diagram of a flowchart of a measurement method provided in the present disclosure.

With reference to FIG. 10, based on the above manual/automatic non-electric-connection borehole clinometer for a landslide, a measurement mode of a clinometer probe 100 is started, the clinometer probe 100 is placed into a clinometer pipe 300, and a pipe orifice support cover 12*d* is tightly fastened to a pipe orifice of the clinometer pipe 300.

A first tooth disc 13 of an automatic clutch is separated from a second tooth disc 15 of the automatic clutch, a first tooth disc 14 of a manual clutch is separated from a second tooth disc 16 of the manual clutch, specifically, a gear actuator rod 7*b* is actuated to a neutral gear, and the clinometer probe 100 slides to a bottom of the clinometer pipe 300 under the action of gravity.

The first tooth disc 13 of the automatic clutch meshes with the second tooth disc 15 of the automatic clutch, the first tooth disc 14 of the manual clutch is separated from the second tooth disc 16 of the manual clutch, specifically, the gear actuator rod 7*b* is actuated to an automatic gear, a probe traction device 200 is started to automatically and intermittently lift the clinometer probe 100, when the clinometer probe 100 rises to the orifice of the clinometer pipe 300 and is blocked by the pipe orifice support cover 12*d*, the probe traction device 200 detects a sudden change of load and stops lifting, such that the measurement of the clinometer pipe 300 is completed, and the probe traction device 200 automatically stops lifting the clinometer probe 100.

When power supplied to a power battery 6*c* in the clinometer probe 100 is insufficient, the first tooth disc 13 of the automatic clutch is separated from the second tooth disc 15 of the automatic clutch, the first tooth disc 14 of the manual clutch meshes with the second tooth disc 16 of the manual clutch, specifically, the gear actuator rod 7*b* is actuated to a manual gear, and a manual rocking handle 11*a* is manually and continuously rotated to transmit intermittent motion by a manual gear speed regulator 11*b*, so as to intermittently lift the clinometer probe 100 until the clinometer probe 100 reaches the orifice to complete measurement.

The pipe orifice support cover 12*d* is detached, the clinometer probe 100 is taken out from the clinometer pipe 300, the measurement mode of the clinometer probe 100 is closed, clinometer data measured by the clinometer probe 100 are obtained, and specifically, the measured clinometer data are copied by an interface module 4.

Figure 9:
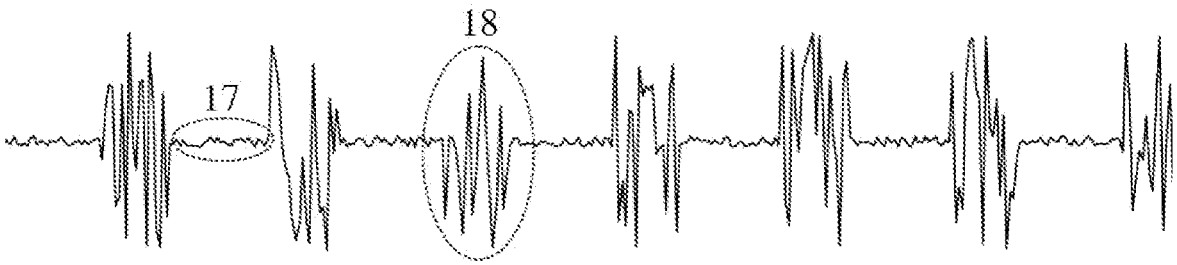
FIG. 9 is a data pattern graph of an embodiment of a data extraction method provided in the present disclosure.

An effective measurement point data segment 17 is extracted from the clinometer data, a stable data segment is captured to calculate a mean value, such that inclination angle information of a corresponding measurement point position is calculated. The type of the clinometer data is shown in FIG. 9, as the clinometer probe 100 is intermittently lifted in the clinometer pipe 300 in a measurement process, the recorded data type is in an intermittent stable and violent fluctuation state shown in FIG. 9, in an intermittent process, the clinometer circuit module 3 records the effective measurement point data segment 17 corresponding to each measurement point position of the clinometer pipe 300, and in a lifting process, the clinometer circuit module 3 records a lifting process data segment 18. During data extraction, the effective measurement point data segment 17 is identified according to data segment features, a segment of stable value is captured to calculate the mean value, and accordingly, the inclination angle information of the corresponding measurement point may be acquired.

In the technical solution provided in the present disclosure:

A probe traction device 200 is connected to a clinometer probe 100 by a pull rope 9*b* instead of a traditional cable, the non-electric-connection mode, that is the pull rope 9*b*, removes limitation on a depth of a monitoring hole due to the problems of a limited signal transmission distance, a large far-end power supply voltage drop, a large cable weight, etc., manual measurement and automatic measurement are integrated, a measurement mode is flexible and convenient to switch, and the comprehensive measurement cost is low.

A monitoring speed and frequency of an automatic gear in the probe traction device 200 are adjustable, which may meet low-frequency monitoring in a landslide creep stage and may also meet high-frequency and quick-response monitoring requirements in a landslide severe sliding or accelerated deformation stage, thereby having important significance in deep deformation monitoring of landslide disasters. The traditional cable connection method is not used between the probe traction device 200 and the clinometer probe 100, and a used steel wire rope non-electric connection mode eliminates the limitation on the depth of the monitoring hole due to the problems of the limited signal transmission distance, the large far-end power supply voltage drop, the large cable dead weight, etc. With wide application scenes, the present disclosure can work in all weather, all over the world and in all time. With mature technologies, the present disclosure has reasonable design and good economical efficiency, and is convenient to popularize and suitable for deep deformation monitoring of landslide disasters.

Herein, the involved terms front, rear, upper, lower, etc., are defined in terms of the positions of parts and between the parts in the drawings, just for clarity and convenience of expressing the technical solution. It should be understood that the use of such parties should not limit the scope of protection of the claimed application.

The above embodiments and the features of the embodiments herein may be combined with each other without conflict.

The above embodiment is merely a preferred embodiment of the present disclosure but not intended to limit the present disclosure, and any modifications, equivalent replacements, improvements, etc. made within the spirit and principles of the present disclosure shall fall within the scope of protection of the present disclosure.

What is claimed is:

1. A manual/automatic non-electric-connection borehole clinometer for a landslide, comprising:

a clinometer probe capable of being lowered into a clinometer pipe by a pull rope, measuring, without limitation of electric connection, a depth of a borehole, and acquiring and storing inclination data of each measurement point in the clinometer pipe;

a probe traction device comprising a hoisting mechanism, an electric driving mechanism and a manual driving mechanism; wherein the pull rope of the hoisting mechanism is connected to the clinometer probe to lift the clinometer probe upwards; a first tooth disc of an automatic clutch and a first tooth disc of a manual clutch are fixed to a left shaft end and a right shaft end of the hoisting mechanism respectively, a second tooth disc of the automatic clutch is fixed to a driving shaft of the electric driving mechanism and selectively meshes with or moves away from the first tooth disc of the automatic clutch, and a second tooth disc of the manual clutch is fixed to a driving shaft of the manual driving mechanism and selectively meshes with or moves away from the first tooth disc of the manual clutch; and when the second tooth disc of the automatic clutch meshes with the first tooth disc of the automatic clutch, the driving shaft of the electric driving mechanism drives the hoisting mechanism to regularly and intermittently lift the clinometer probe upwards, and when the second tooth disc of the manual clutch meshes with the first tooth disc of the manual clutch, the driving shaft of the manual driving mechanism drives the hoisting mechanism to regularly and intermittently lift the clinometer probe upwards.

2. The manual/automatic non-electric-connection borehole clinometer for a landslide according to claim 1, wherein the probe traction device further comprises a base, the hoisting mechanism is fixed to the base, and the electric driving mechanism and the manual driving mechanism are movably mounted on the base and located on a left side and a right side of the hoisting mechanism respectively.

3. The manual/automatic non-electric-connection borehole clinometer for a landslide according to claim 2, wherein the probe traction device further comprises a gantry, a slide rail extending in a left-right direction is arranged on the base, a slider in sliding fit with the slide rail is fixed to a bottom of the gantry, the hoisting mechanism is located on an inner side of the gantry, the electric driving mechanism and the manual driving mechanism are fixed to the gantry separately, the electric driving mechanism and the manual driving mechanism are located on a left side and a right side of the hoisting mechanism respectively and spaced from same, and the hoisting mechanism is located between the second tooth disc of the automatic clutch and the second tooth disc of the manual clutch and spaced from same.

4. The manual/automatic non-electric-connection borehole clinometer for a landslide according to claim 3, wherein a gear actuator rod is fixed to a top of the gantry, the probe traction device further comprises a case housing, the base is covered with an opening in a lower side of the case housing, the hoisting mechanism, the electric driving mechanism and the manual driving mechanism are located in the case housing, a gear hole is provided in a position, opposite the gear actuator rod, of the case housing, three gear clamping grooves are provided in a side wall of the gear hole in a left-right direction, an elastic sheet is arranged on one side, facing the gear clamping grooves, of the gear actuator rod, the elastic sheet is located in the gear clamping groove, and an upper end of the gear actuator rod is located above the case housing;

when the gear actuator rod is located in the rightmost gear clamping groove, the first tooth disc of the manual clutch meshes with the second tooth disc of the manual clutch; when the gear actuator rod is located in the middle gear clamping groove, the first tooth disc of the manual clutch is spaced from the second tooth disc of the manual clutch, and the first tooth disc of the automatic clutch is spaced from the second tooth disc of the automatic clutch; and when the gear actuator rod is located in the leftmost gear clamping groove, the first tooth disc of the automatic clutch meshes with the second tooth disc of the automatic clutch.

5. The manual/automatic non-electric-connection borehole clinometer for a landslide according to claim 3, wherein the automatic driving mechanism comprises a stepping driving motor and a motor reducer, the motor reducer and the stepping driving motor being connected together and fixed to the gantry.

6. The manual/automatic non-electric-connection borehole clinometer for a landslide according to claim 3, wherein the manual driving mechanism comprises a manual rocking handle and a manual gear speed regulator, the manual gear speed regulator being fixed to the gantry, and the manual rocking handle being connected to the manual gear speed regulator and driving the manual gear speed regulator to rotate.

7. The manual/automatic non-electric-connection borehole clinometer for a landslide according to claim 2, wherein the probe traction device further comprises a position measurement mechanism, the position measurement mechanism comprising a rotary encoder and a rotary coupling wheel, the rotary encoder is mounted on the base, the rotary coupling wheel is mounted on an input shaft of the rotary encoder, the pull rope is wound around the rotary coupling wheel by a circle, and the rotary encoder is used for acquiring a rotation distance of the rotary coupling wheel so as to acquire a pull distance of the pull rope.

8. The manual/automatic non-electric-connection borehole clinometer for a landslide according to claim 7, wherein the position measurement mechanism further comprises a rope arranging cover, the rope arranging cover being fixed to the base, the rotary coupling wheel being located in the rope arranging cover, a shaft penetrating hole penetrating a position, opposite the input shaft of the rotary encoder, of the rope arranging cover, and threading holes penetrating two ends of the rope arranging cover and two ends of the pull rope.

9. The manual/automatic non-electric-connection borehole clinometer for a landslide according to claim 1, wherein the clinometer probe comprises a probe pipe housing, an upper end and a lower end of the probe pipe housing are separately provided with guide roller devices, the guide roller devices are configured to roll in a guide groove of the clinometer pipe, a clinometer circuit module, an interface module and a power supply module are fixed in the probe pipe housing, the clinometer circuit module is used for acquiring and storing clinometer data, the interface module is configured to be connected to an external apparatus to transmit the clinometer data, and the power supply module is electrically connected to the clinometer circuit module to supply power.

10. A measurement method, using the manual/automatic non-electric-connection borehole clinometer for a landslide according to claim 1 and comprising:

S1, starting a measurement mode of a clinometer probe, and placing the clinometer probe into a clinometer pipe;

S2, separating a first tooth disc of an automatic clutch from a second tooth disc of the automatic clutch, separating a first tooth disc of a manual clutch from a second tooth disc of the manual clutch, and making the clinometer probe slide to a bottom of the clinometer pipe under the action of gravity;

S3, making the first tooth disc of the automatic clutch mesh with the second tooth disc of the automatic clutch, separating the first tooth disc of the manual clutch from the second tooth disc of the manual clutch, starting a probe traction device to automatically and intermittently lift the clinometer probe, and stopping lifting until the clinometer probe ascends to a pipe opening of the clinometer pipe, so as to complete the measurement of the clinometer pipe; or separating, when power supplied to the clinometer probe is insufficient, the first tooth disc of the automatic clutch from the second tooth disc of the automatic clutch, making the first tooth disc of the manual clutch mesh with the second tooth disc of the manual clutch, and manually and continuously rotating a manual rocking handle to transmit intermittent motion by a manual gear speed regulator, so as to intermittently lift the clinometer probe until the clinometer probe reaches the orifice to complete measurement;

S4, taking out the clinometer probe from the clinometer pipe, closing the measurement mode of the clinometer probe, and acquiring clinometer data measured by the clinometer probe; and

S5, extracting an effective measurement point data segment from the clinometer data, and capturing a stable data segment to calculate a mean value, so as to calculate inclination angle information of a corresponding measurement point position.

* * * * *